US008505372B2

(12) United States Patent
Cho et al.

(10) Patent No.: US 8,505,372 B2
(45) Date of Patent: Aug. 13, 2013

(54) CAM TARGET WHEEL FOR VEHICLE

(75) Inventors: Myung Rae Cho, Icheon (KR); Hong Wook Lee, Seongnam-si (KR); Sang Hee Lee, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 13/316,383

(22) Filed: Dec. 9, 2011

(65) Prior Publication Data

US 2013/0081456 A1 Apr. 4, 2013

(30) Foreign Application Priority Data

Sep. 29, 2011 (KR) ..... 10-2011-0099106

(51) Int. Cl.
*G01M 15/00* (2006.01)

(52) U.S. Cl.
USPC ..... 73/114.77

(58) Field of Classification Search
USPC ..... 73/114.77
See application file for complete search history.

(56) References Cited

U.S. PATENT DOCUMENTS

| | | | | |
|---|---|---|---|---|
| 5,469,823 | A * | 11/1995 | Ott et al. | 123/406.62 |
| 6,041,647 | A * | 3/2000 | Matsuoka | 73/114.26 |
| 6,305,353 | B1 * | 10/2001 | Weber et al. | 123/406.58 |
| 6,736,095 | B2 * | 5/2004 | Pierik | 123/90.16 |
| 7,007,652 | B2 * | 3/2006 | Williams | 123/90.6 |
| 7,013,719 | B2 * | 3/2006 | Adachi et al. | 73/114.27 |
| 7,143,728 | B1 * | 12/2006 | Yasui | 123/90.15 |
| 7,213,552 | B1 * | 5/2007 | Griffiths | 123/90.16 |
| 7,475,682 | B2 * | 1/2009 | Galtier et al. | 123/612 |
| 2012/0192841 | A1 * | 8/2012 | Meldolesi et al. | 123/70 R |

FOREIGN PATENT DOCUMENTS

| | | |
|---|---|---|
| KR | 10-1998-021948 | 6/1998 |
| KR | 1998-044893 U | 9/1998 |
| KR | U2000-0020192 | 11/2000 |
| KR | 10-2005-0069053 A | 12/2003 |

* cited by examiner

*Primary Examiner* — Freddie Kirkland, III
(74) *Attorney, Agent, or Firm* — Morgan, Lewis & Bockius LLP

(57) ABSTRACT

A cam target wheel for a vehicle may include a camshaft; and a lobe, formed on an outer circumferential surface of the camshaft, for recognizing a ridge and valley of a cam vibration waveform.

6 Claims, 2 Drawing Sheets

CAM TARGET WHEEL FOR VEHICLE

CROSS-REFERENCE TO RELATED APPLICATION

The present application claims priority to Korean Patent Application No.10-2011-0099106, filed on Sep. 29, 2011 in the Korean Intellectual Property Office, the entire contents of which is incorporated herein for all purposes by this reference.

BACKGROUND OF THE INVENTION

1. Field of the Invention

The present invention relates to a cam target wheel for a vehicle, and more particularly, to a cam target wheel which can recognize vibration of a camshaft to improve the operability of the camshaft.

2. Description of Related Art

In general, engines employing continuously variable valve timing (CVVT) are provided with a cam target wheel for recognizing a cam phase.

A cam target wheel 101 for a vehicle in the related art includes, as shown in FIG. 1, a camshaft 110, and a lobe 120 protruding at a desired angle (θ') from an outer circumferential surface of the camshaft 110. In this instance, the angle (θ') of the lobe 120 is 180 degrees.

The conventional cam target wheel 101 including the semicircular lobe 120 calculates a phase with a square wave of 180° interval (360° for a crank). A torque variation of each cylinder due to explosion and a torque variation of the camshaft 110 occur for every cylinder, and these torque variations cause cams to periodically vibrate in unit of a cylinder (180°).

In particular, in an application to which the CVVT controlled by a hydraulic pressure is applied, the vibration of the camshaft 110 occurs periodically at an interval of 180°. However, since the semicircular cam target wheel 101 in the related art recognizes the phase of the camshaft 110 at an equal interval of 360° on the basis of the crank, there is a problem in that it cannot recognize the cam vibration.

That is, as shown in FIG. 2, in CASE 1 and CASE 2 which are conducted under the same driving conditions, an ECU recognizes that the cam shaft 110 is equally controlled on the basis of the signal from the sensor of the cam target wheel. In fact, however, there is a problem in CASE 2 in that the cam is excessively vibrated, but the ECU does not recognize the cam vibration because of the property of the semicircular shape. In particular, in the case where the cam is excessively vibrated, there is a drawback in that since valve open/close timing is changed, an engine output is deteriorated.

In order to solve the above problems, the outer circumferential surface of the camshaft 110 is provided with a plurality of lobes 120 to improve the ability to recognize the cam vibration. However, if a plurality of lobes 120 are provided, a significant change such as logic development or factory line change is needed to raise a manufacturing cost.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a cam target wheel for a vehicle which can lower its manufacturing cost by not increasing the number of lobes, and improve the operating reliability by recognizing cam vibration.

In one aspect of the present invention, a cam target wheel for a vehicle may include a camshaft, and a lobe, formed on an outer circumferential surface of the camshaft, for recognizing a ridge and valley of a cam vibration waveform.

The lobe protrudes continuously from the outer circumferential surface of the camshaft, and may have an obtuse angle with respect to a center of the camshaft, wherein the obtuse angle ranges between approximately 125° (180°−55°) and approximately 145° (180°−35°).

The lobe protrudes continuously from the outer circumferential surface of the camshaft, and may have an angle ranging between approximately 215° (180°+35°) and approximately 235° (180°+55°).

With the cam target wheel for the vehicle according to the present invention, since the number of the lobes is not increased, its manufacturing cost is lowered, and since the cam vibration is recognized, the operating reliability is improved.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
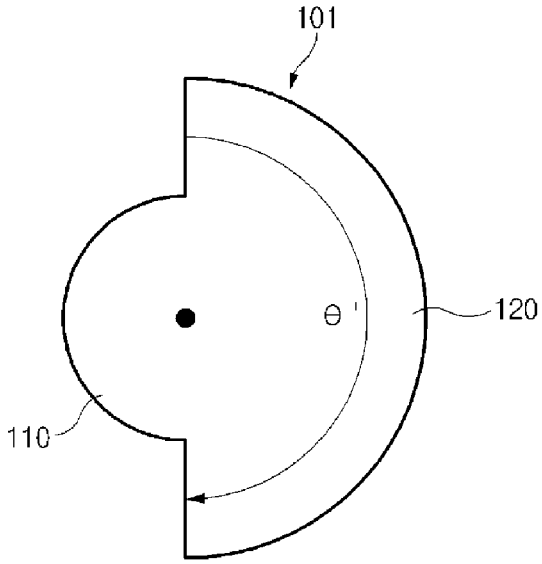
FIG. 1 (Related Art)
FIG. 1 is a cross-sectional view illustrating a cam target wheel for a vehicle in the related art.
Figure 2:
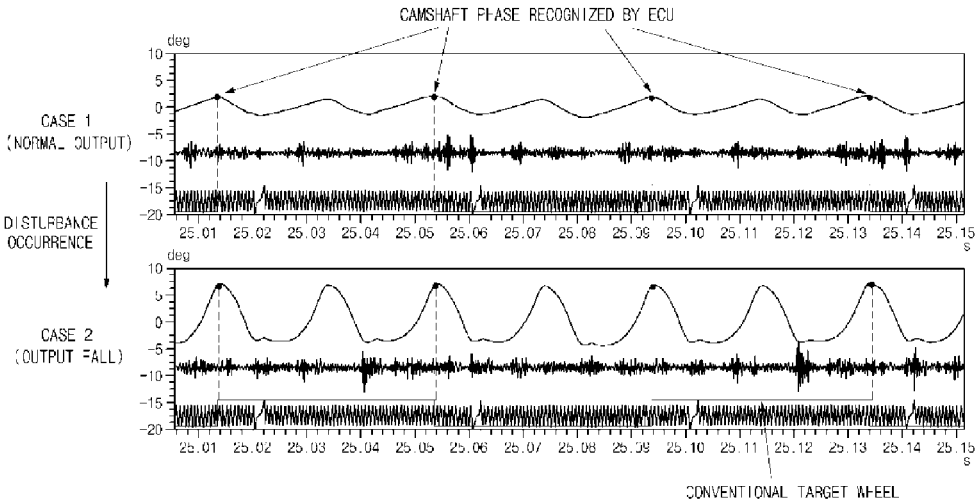
FIG. 2 (Related Art)
FIG. 2 is a graph explaining a problem of a cam target wheel for a vehicle in the related art.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 3:
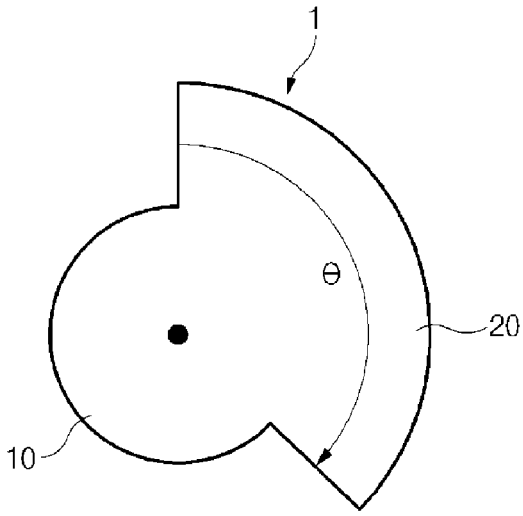
FIG. 3 is a cross-sectional view illustrating a cam target wheel for a vehicle according to an exemplary embodiment of the present invention.
Figure 4:
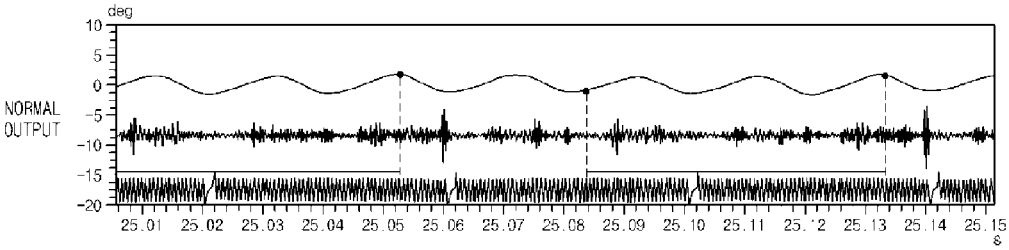
FIG. 4 is a graph illustrating an output state of the cam target wheel for the vehicle according to an exemplary embodiment of the present invention.

FIG. 3 is a cross-sectional view illustrating a cam target wheel for a vehicle according to an exemplary embodiment of the present invention, and FIG. 4 is a graph illustrating an output state of the cam target wheel for the vehicle according to an exemplary embodiment of the present invention.

A cam target wheel 1 for a vehicle according to an exemplary embodiment of the present invention includes, as shown in FIG. 3, a camshaft 10, and a lobe 20, formed on the outer circumferential surface of the camshaft 10, for recognizing a ridge and valley of a cam vibration waveform by a sensing device.

It is preferable that the lobe 20 protrudes continuously from the outer circumferential surface of the camshaft 10, and its angle (θ) is in the range of 125° (180°−55°) to 145° (180°−35°). In particular, the angle (θ) of the lobe 20 is set to 135° in the present embodiment. According to the result of a test in which the above angle of the lobe was applied to the cam target wheel 1 and the cam vibration was tested, as shown in FIG. 4, the ridge and valley of the cam vibration waveform was accurately recognized. Therefore, since the cam vibration is controlled in the same level as the normal output of the cam vibration, the operating reliability is improved.

In addition, since the cam target wheel 1 according to an exemplary embodiment of the present invention is not provided with a plurality of lobes, but provided with only one lobe 20 to recognize the cam vibration, it is not necessary to change the logic or the factory facility, thereby preventing the manufacturing cost from being raised.

In the cam target wheel 1 according to the exemplary embodiment, Of course, the lobe has the angle (θ) of 125° (180°−55°) to 145° (180°−35°), but the angle can be in the range of 215° (180°+35°) to 235° (180°+55°).

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A cam target wheel for a vehicle comprising:

a camshaft; and a lobe, formed on an outer circumferential surface of the camshaft, for recognizing a ridge and valley of a cam vibration waveform, wherein the lobe protrudes continuously from the outer circumferential surface of the camshaft, and has an obtuse angle with respect to a center of the camshaft.

2. The cam target wheel according to claim 1, wherein the obtuse angle ranges between approximately 125° (180°−55°) and approximately 145° (180°−35°).

3. The cam target wheel according to claim 1, wherein the lobe protrudes continuously from the outer circumferential surface of the camshaft, and has an angle ranging between approximately 215° (180°+35°) and approximately 235° (180°+55°).

4. The cam target wheel according to claim 1, wherein the ridge and the valley of the cam is recognized by a sensing device.

5. A cam target wheel for a vehicle comprising:

a camshaft; and a lobe, formed on an outer circumferential surface of the camshaft, for recognizing a ridge and valley of a cam vibration waveform, wherein the lobe protrudes continuously from the outer circumferential surface of the camshaft, and has an angle ranging between approximately 215° (180°+35°) and approximately 235° (180°+55°).

6. The cam target wheel according to claim 5, wherein the ridge and the valley of the cam is recognized by a sensing device.

* * * * *